US007128615B1

(12) United States Patent
Liao

(10) Patent No.: US 7,128,615 B1
(45) Date of Patent: Oct. 31, 2006

(54) CONNECTOR ASSEMBLY

(76) Inventor: Sheng-Hsin Liao, No. 10, Alley 38, Lane 229, San Chun St., Shulin City, Taipei Hsien (TW)

( * ) Notice: Subject to any disclaimer, the term of this patent is extended or adjusted under 35 U.S.C. 154(b) by 0 days.

(21) Appl. No.: 11/410,890

(22) Filed: Apr. 26, 2006

(51) Int. Cl.
*H01R 25/00* (2006.01)

(52) U.S. Cl. ..... 439/640

(58) Field of Classification Search ..... 439/640, 439/165, 31, 32, 173
See application file for complete search history.

(56) References Cited

U.S. PATENT DOCUMENTS 4,437,716 A * 3/1984 Cooper ..... 439/31
4,450,495 A * 5/1984 Naruki ..... 360/137
5,189,431 A * 2/1993 Marinelli ..... 343/718
5,541,813 A * 7/1996 Satoh et al. ..... 361/752
6,722,892 B1 * 4/2004 Blakelock ..... 439/31
6,991,467 B1 * 1/2006 Cheng et al. ..... 439/10
2004/0216271 A1 * 11/2004 Schott ..... 16/234
2006/0160377 A1 * 7/2006 Huang ..... 439/31

FOREIGN PATENT DOCUMENTS

TW 570391 1/1992

* cited by examiner

*Primary Examiner*—Phuong Dinh
(74) *Attorney, Agent, or Firm*—Rosenberg, Klein & Lee

(57) ABSTRACT

A connector assembly comprises a first connector, a second connector, at least one outer sliding element, at least one inner sliding element, a first shaft and a second shaft. The second connector is connected with the first connector by a signal cable, and the inner sliding element is relatively slid and rotated with the outer sliding element; the first shaft is rotatably and pivotally engaged with the first connector and the second shaft is rotatably and pivotally engaged with the second connector, and outer sliding element and the inner sliding element are connected between the first shaft and the second shaft. Consequently, the multi-turning connecting head has a multi-direction rotational function and a different-length adjustable function.

18 Claims, 8 Drawing Sheets

CONNECTOR ASSEMBLY

BACKGROUND OF THE INVENTION

1. Field of the Invention

The present invention relates to a connector assembly, and more particularly to a multi-turning connecting head for electrically connecting.

2. Description of the Prior Art

Recently with the rapidly development of computer technology, many peripheral equipment related to the computers continuously increase, and the development of the Internet brings complicated connection problems between the peripheral equipment and the portable computers, desktop computers or servers. However, the computer engineers develop different kinds of connecting head such as the USB, IEEE 1394, and PS2 etc. for solving the complicated connection problems between the peripheral equipment and the computer hosts.

In general, the connecting heads of the USB, IEEE 1394, and PS2 etc. are directly inserted into the connecting ports or the connecting sockets that the connecting heads easily interfere with use of the adjacent socket or are extruded so as to decrease the life cycle when being used in a limited space or near the wall.

Taiwanese Patent No. 570,391 discloses a multi-turning connecting head for computer equipment. Wherein the connecting head has a multi-direction rotational function for providing a rotational connection so as to avoid interfering use of the adjacent socket, and when being used in a limited space or near the wall, the connecting head does not be extruded so as to increase the life cycle.

However, although the connecting head of the prior art has the multi-direction rotational function, the connecting head does not a flexible function for adjusting. Hence, the connecting head of the prior art has a limited operation.

The inventor of the present invention recognizes the above shortage should be corrected and special effort has been paid to research this field. The present invention is presented with reasonable design and good effect to resolve the above problems.

SUMMARY OF THE INVENTION

It is a primary object of the present invention to provide a multi-turning connecting head that has a multi-direction rotational function and a different-length adjustable function according to the requirements and operation habits of the different users so that the multi-turning connecting head has a good flexibility for operating.

For achieving the primary objective stated above, the present invention provides a connector assembly comprises a first connector, a second connector connected with the first connector by a signal cable, at least one outer sliding element, at least one inner sliding element is relatively slid and rotated with the outer sliding element, a first shaft is rotatably pivotally engaged with the first connector, and a second shaft is rotatably pivotally engaged with the second connector, and the outer sliding element and the inner sliding element are connected between the first shaft and the second shaft.

It is to be understood that both the foregoing general description and the following detailed description are exemplary, and are intended to provide further explanation of the invention as claimed. Other advantages and features of the invention will be apparent from the following description, drawings and claims.

BRIEF DESCRIPTION OF THE DRAWINGS

The above and further advantages of this invention may be better understood by referring to the following description, taken in conjunction with the accompanying drawings, in which.

DETAILED DESCRIPTION OF THE PREFERRED EMBODIMENTS

Figure 1:
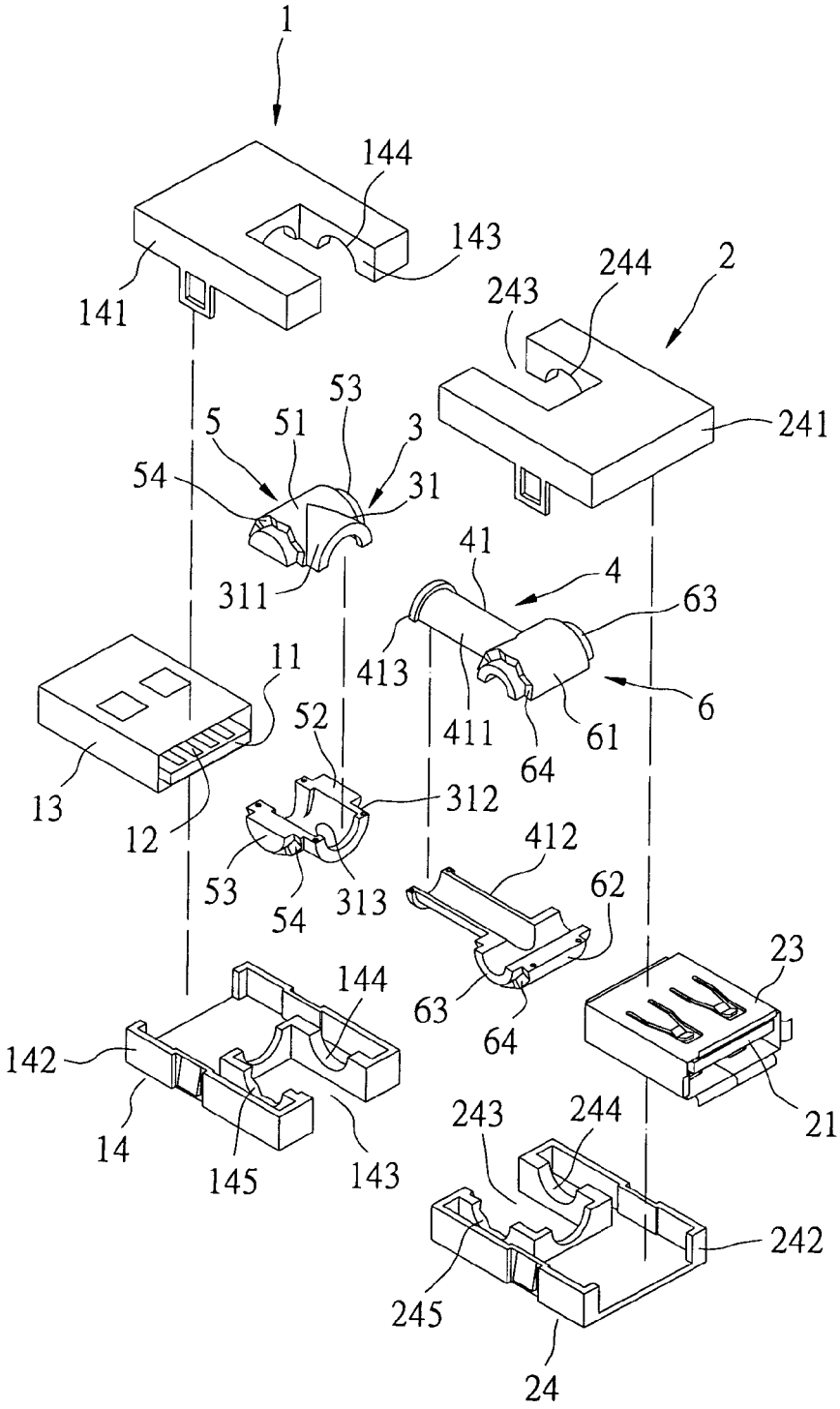
FIG. 1 is an exploded perspective view of a first embodiment of a multi-turning connecting head of the present invention.
Figure 2:
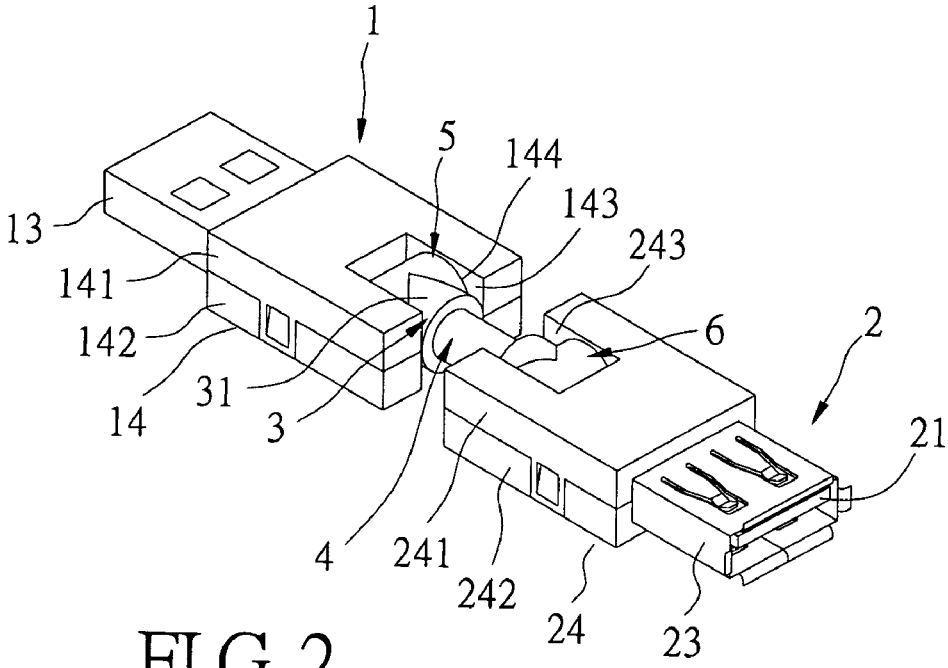
FIG. 2 is a perspective view of the first embodiment of the multi-turning connecting head of the present invention.
Figure 4:
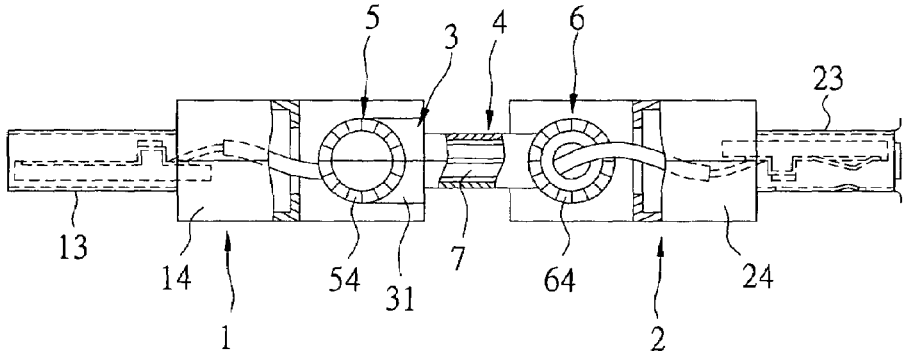
FIG. 4 is a side cross-sectional view of the first embodiment of the multi-turning connecting head of the present invention.

References are made from FIG. 1 and FIG. 4. The present invention provides a connector assembly comprises a first connector 1, a second connector 2, at least one outer sliding element 3, at least one inner sliding element 4, a first shaft 5 and a second shaft 6. The first connector 1 can be an USB, IEEE 1394, PS2 or any other kinds of connectors. The first connector 1 comprises an insulated housing 11 is made of plastic material, a plurality of terminals 12 are made of metal material are disposed on the insulated housing 11, a shielding casing 13 is made of metal material covers the insulated housing 11 and the terminals 12 and a rear end of the shielding casing 13 is covered with an outer casing 14 is made of plastic material. The outer casing 14 comprises an upper half shell 141 and a lower half shell 142 are formed together by using a hooking way or a sticking way. A rear end of the outer casing 14 forms a notch 143, and the notch 143 is inserted into an appropriate length of the outer casing 14 for containing the outer sliding element 3 and the first shaft 5. Each of two ends of the notch 143 relatively forms a cambered-shaped contacting surface 144 for pivotally engaging with the first shaft 5.

The second connector 2 can be an USB, IEEE 1394, PS2 or other kind of connectors. The second connector 2 comprises an insulated housing 21 is made of plastic material, a plurality of terminals (not shown) are made of metal material are disposed on the insulated housing 21, a shielding casing 23 is made of metal material covers the insulated housing 21 and the terminals and a rear end of the shielding casing 23 is covered with an outer casing 24 is made of plastic material. The outer casing 24 comprises an upper half shell 241 and a lower half shell 242 are formed together by using a hooking way or a sticking way. A rear end of the outer casing 24 forms a notch 243, and the notch 243 is inserted into an appropriate length of the outer casing 24 for containing the inner sliding element 4 and the second shaft 6. Each of two ends of the notch 243 relatively forms a cambered-shaped contacting surface 244 for pivotally engaging with the first shaft 6.

The outer sliding element 3 is a sliding component. In this embodiment, the outer sliding element 3 is an outer sleeve 31, the outer sleeve 31 comprises an upper half shell 311 and a lower half shell 312 are formed together by using a hooking way or a sticking way. The two half shells 311, 312 are hollow semi-cylindrical shaped in opposition so that the two half shells 311, 312 form a hollow cylindrical shaped outer sleeve 31 for hitching on an outside of the inner sliding element 4.

The inner sliding element 4 is a sliding component. In this embodiment, the inner sliding element 4 is an inner sleeve 41, the inner sleeve 41 comprises an upper half shell 411 and a lower half shell 412 are formed together by using a hooking way or a sticking way. The two half shells 411, 412 are hollow semi-cylindrical shaped in opposition so that the two half shells 411, 412 form a hollow cylindrical shaped inner sleeve 41 is inserted in an inside of the outer sliding element 3 for mutually connecting the outer sliding element 3 and the inner sliding element 4 to form a flexible mechanism. An outer wall of the one side of the inner sliding element 4 forms a flange 413 and an inner wall of the one side of the outer sliding element 3 forms a flange 313, and the flange 413 and the flange 313 are mutually pressed for preventing the separation of the inner sliding element 4 and the outer sliding element 3. The outer sliding element 3 axially relatively slides to the inner sliding element 4 for adjusting the different lengths, and the outer sliding element 3 relatively rotates to the inner sliding element 4 for having a multi-direction rotational function.

In this embodiment, the first shaft 5 is integrally formed with the outer sliding element 3 so that the outer sliding element 3 is connected with the first shaft 5. The first shaft 5 comprises an upper half shell 51 and a lower half shell 52 are formed together by using a hooking way or a sticking way. The two half shells 51, 52 are hollow semi-cylindrical shaped in opposition so that the two half shells 51, 52 form a hollow cylindrical shaped first shaft 5. Each of two ends of the first shaft 5 is separately formed a pivotal portion 53 and the first shaft 5 is laterally installed in the notch 143 of the first connector 1, and the first shaft 5 is pivotally engaged with the contacting surface 144 corresponds to the first connector 1 by the pivotal portions 53 so that the first shaft 5 and the outer sliding element 3 are rotatably pivotally engaged with the first connector 1.

In this embodiment, the second shaft 6 is integrally formed with the inner sliding element 4 so that the inner sliding element 4 is connected with the second shaft 6 and the outer sliding element 3 and the inner sliding element 4 are connected between the first shaft 5 and the second shaft 6. The second shaft 6 comprises an upper half shell 61 and a lower half shell 62 are formed together by using a hooking way or a sticking way. The two half shells 61, 62 are hollow semi-cylindrical shaped in opposition so that the two half shells 61, 62 form a hollow cylindrical shaped second shaft 6. Each of two ends of the second shaft 6 is separately formed a pivotal portion 63 and the second shaft 6 is laterally installed in the notch 243 of the second connector 2, and the second shaft 6 is pivotally engaged with the contacting surface 244 corresponds to the second connector 2 by the pivotal portions 63 so that the second shaft 6 and the inner sliding element 4 are rotatably pivotally engaged with the second connector 2.

Figure 3:
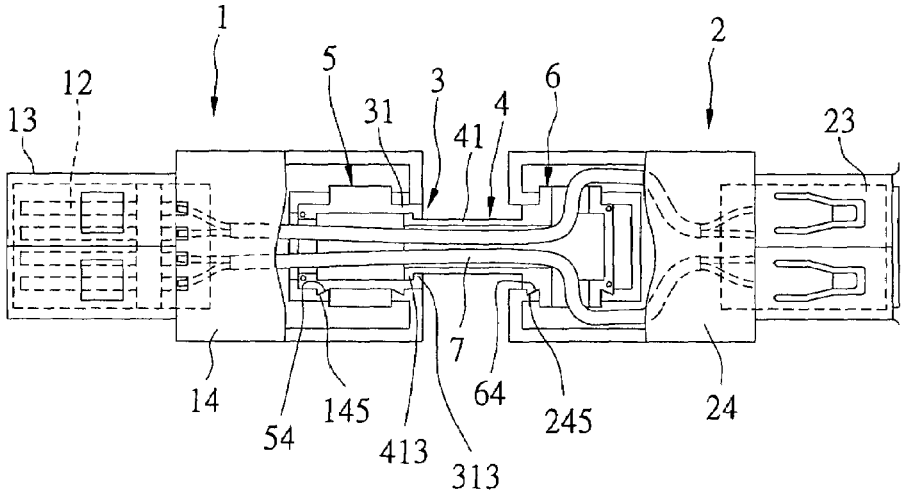
FIG. 3 is a bottom cross-sectional view of the first embodiment of the multi-turning connecting head of the present invention.

References are made to FIG. 3 and FIG. 4. The terminals 12 of the first connector 1 are connected with the terminals (not shown) of the second connector 2 by a plurality of signal cables 7. The signal cables 7 are penetrated in an inside of the outer sliding element 3 and an inside of the inner sliding element 4, and two ends of the signal cables 7 are passed through a middle of the first shaft 5 and the second shaft 6 or two ends of the first shaft 5 and the second shaft 6 so as to be welded with the terminals.

The first shaft 5 has a ring-shaped ratchet 54 and the outer casing 14 of the first connector 1 has a ring-shaped ratchet 145, and the ratchet 54 is mutually engaged with the ratchet 145 so as to result a multi-stage position when the first shaft 5 relatively rotates to the first connector 1. In addition, the second shaft 6 has a ring-shaped ratchet 64 and the outer casing 24 of the second connector 2 has a ring-shaped ratchet 245, and the ratchet 64 is mutually engaged with the ratchet 245 so as to result a multi-stage position when the second shaft 6 relatively rotates to the second connector 2.

Figure 5:
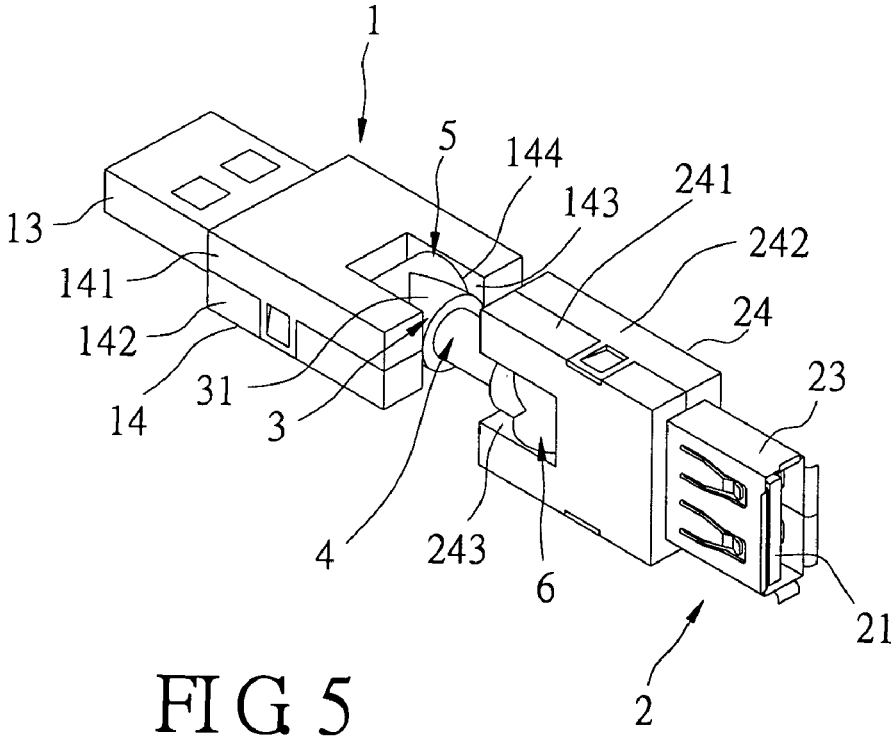
FIG. 5 is a first operational perspective view of adjusting the first embodiment of the multi-turning connecting head of the present invention.
Figure 6:
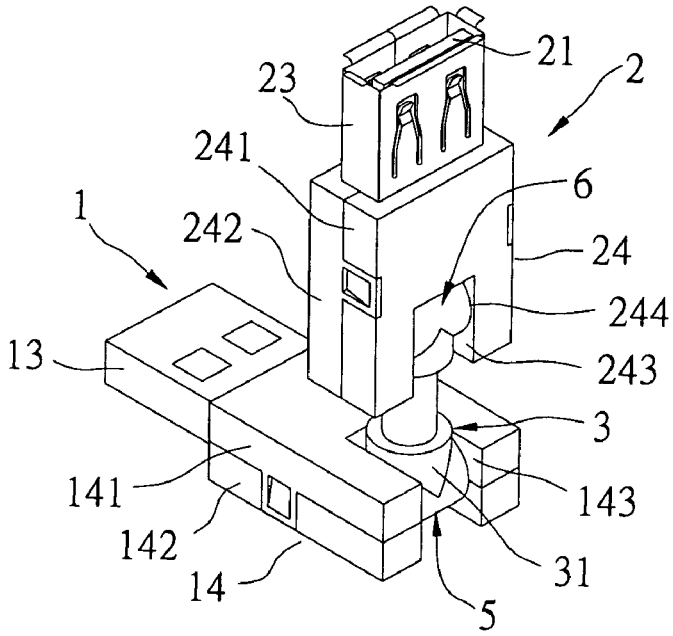
FIG. 6 is a second operational perspective view of adjusting the first embodiment of the multi-turning connecting head of the present invention.
Figure 7:
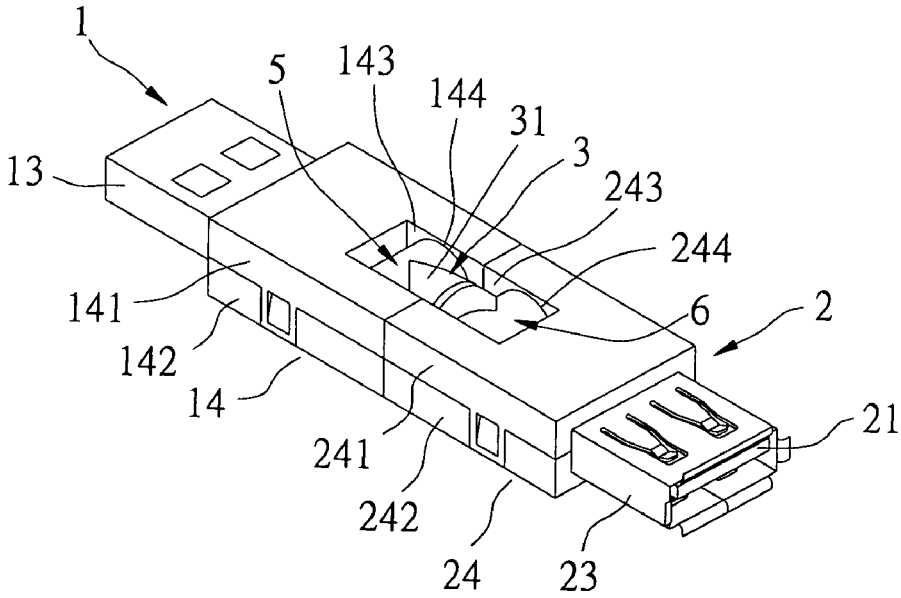
FIG. 7 is a third operational perspective view adjusting the first embodiment of the multi-turning connecting head of the present invention.

A relative rotation between the outer sliding element 3 and the inner sliding element 4 so to result different angles due to the rotation between the first connector 1 and the second connector 2 (shown in FIG. 5), and an axial rotation between the first connector 1 and the second connector 2 by the first shaft 5 and the second shaft 6 (shown in FIG. 6), thereby the present invention has a multi-direction rotational function. Furthermore, a relative axial sliding between the outer sliding element 3 and the inner sliding element 4 is to adjust different lengths (shown in FIG. 7) and to adjust an appropriate distance between the first connector 1 and the second connector 2 and obtain a better application.

Figure 8:
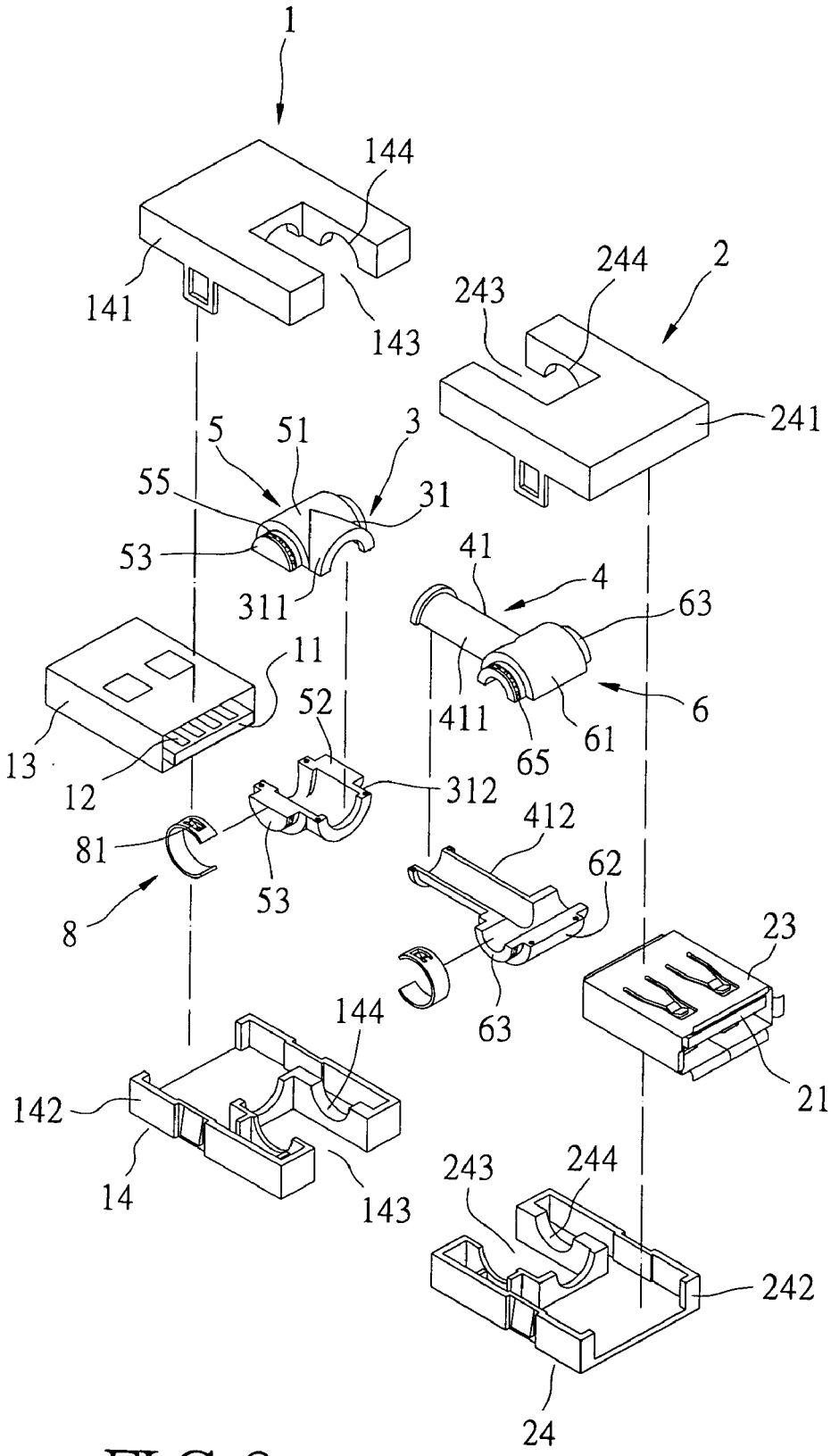
FIG. 8 is an exploded perspective view of a second embodiment of the multi-turning connecting head of the present invention.

Reference is made to FIG. 8. In this embodiment, the outer casing 14 of the first connector 1 and the outer casing 24 of the second connector 2 are separately has a positioning element 8 and the two positioning elements 8 are separately fixed thereon. The two positioning elements 8 are C-shaped and the pivotal portion 53 of the first shaft 5 and the pivotal portion 63 of the second shaft 6 are separately pivotally engaged with the two positioning elements 8, and each of the positioning elements 8 forms a piece-shaped positioning portion 81 is protruded to an inside of the positioning element 8. One end of the first shaft 5 and the second shaft 6 are separately relatively formed a ring-shaped ratchet 55 and a ring-shaped ratchet 65, and the positioning portions 81 of the positioning element 8 are pressed to the corresponding ratchets 55, 56 so to result a multi-stage position when the first shaft 5 and the second shaft 6 relatively rotate to the first connector 1 and the second connector 2.

Figure 9:
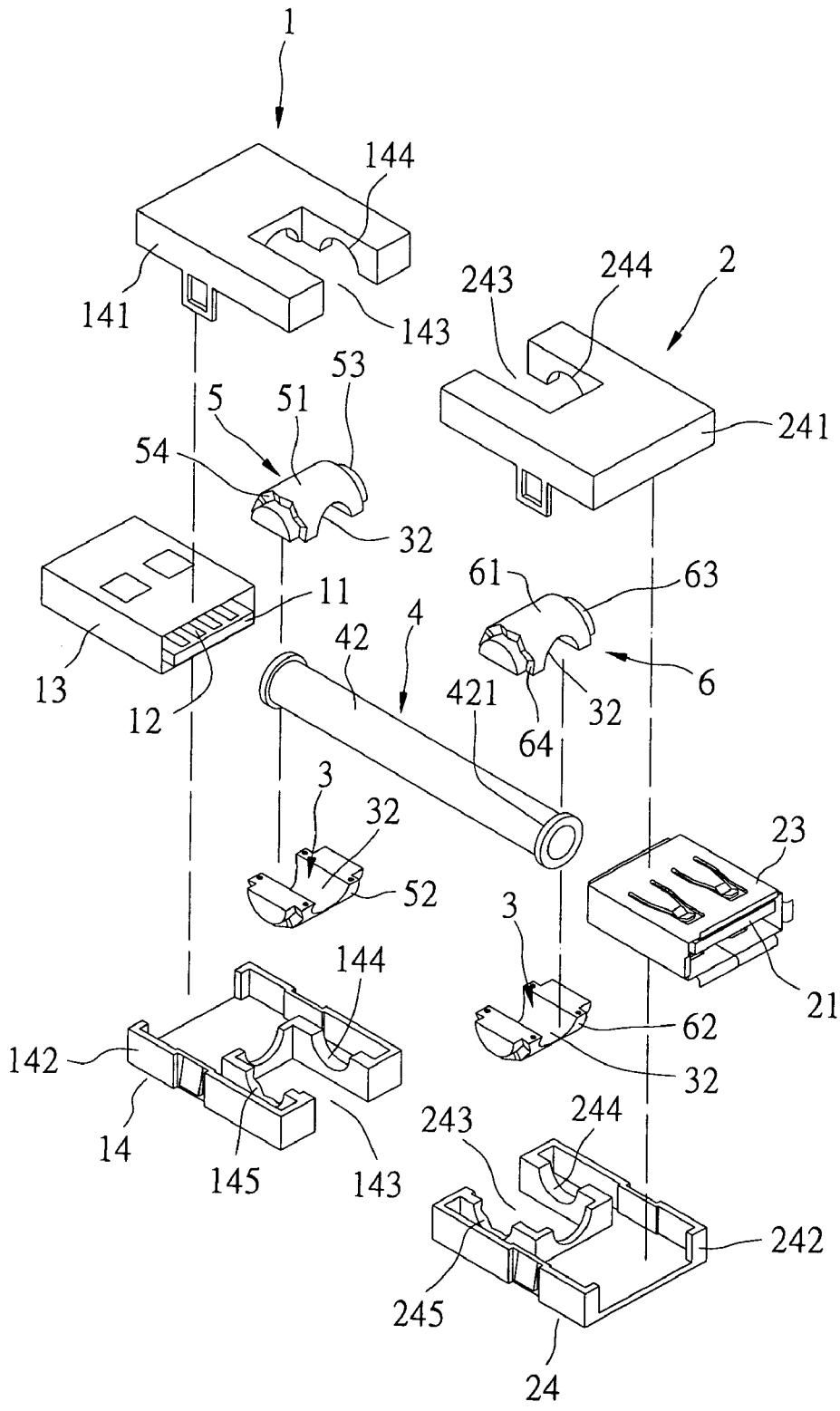
FIG. 9 is an exploded perspective view of a third embodiment of the multi-turning connecting head of the present invention.

Reference is made to FIG. 9. In this embodiment, the outer sliding elements 3 are sliding surfaces 32 are separately formed at each of insides of the two half shells 51, 52 of the first shaft 5 and each of insides of the two half shells 61, 62 of the second shaft 6, and each of the sliding surfaces 32 is a cambered surface and is slidingly hitched on an outside of the inner sliding element 4. The inner sliding element 4 is a sliding component. In this embodiment, the inner sliding element 4 is an inner sleeve 42 and the inner sleeve 42 is hollow cylindrical shaped to be inserted in an inside of the sliding surface 32 of the outer sliding element 3 for mutually connecting the outer sliding element 3 and the inner sliding element 4 to form a flexible mechanism. The outer sliding element 3 axially relatively slides to the inner sliding element 4 for adjusting the different lengths, and the outer sliding element 3 relatively rotates to the inner sliding element 4 for having a multi-direction rotational function. Each end of the inner sliding element 4 forms a flange 421 with a larger outer diameter, and the two flanges 421 are pressed to an outer edge of the outer sliding element 3 for preventing the separation of the inner sliding element 4 and the outer sliding element 3.

Figure 10:
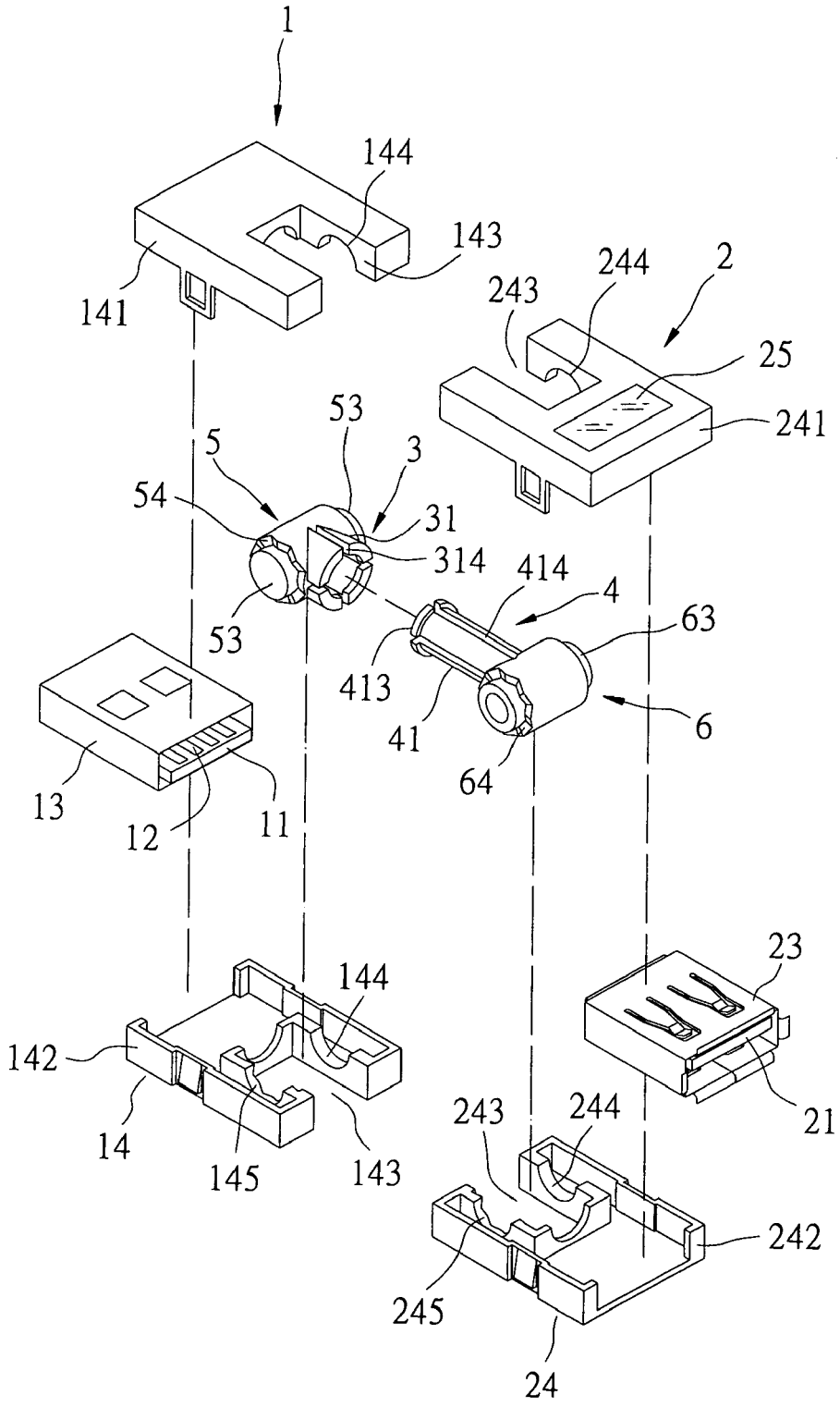
FIG. 10 is an exploded perspective view of a fourth embodiment of the multi-turning connecting head of the present invention.

Reference is made to FIG. 10. The outer sliding element 3, the inner sliding element 4, the first shaft 5 and second shaft 6 form an integrated structure and the outer sliding element 3 and the inner sliding element 4 are separately has a groove 314 and a groove 414 so that diameters of the outer sliding element 3 and the inner sliding element 4 are elastically varied so as to easily assemble the outer sliding element 3 and the inner sliding element 4. In addition, the second connector 2 or the first connector 1 has a fingerprint verifier 25 for verifying identify of the user.

Figure 11:
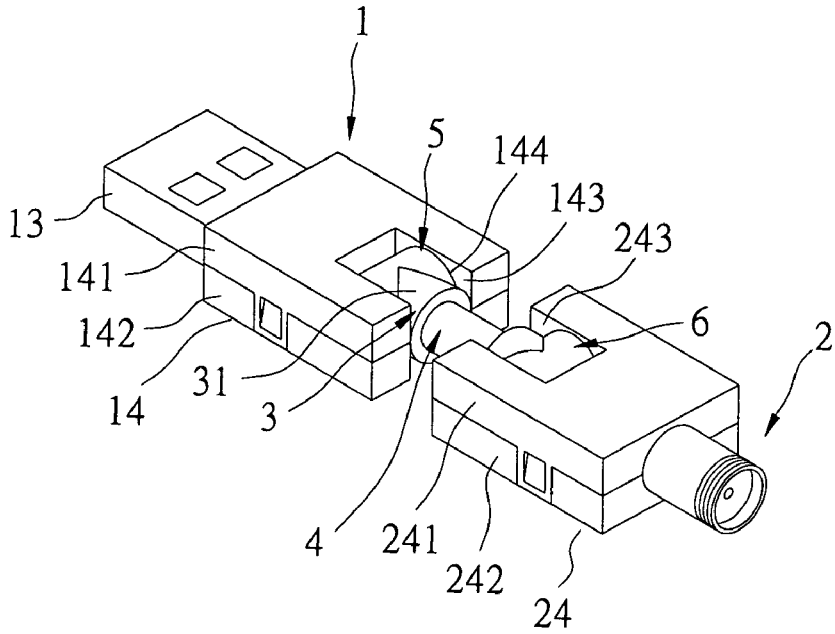
FIG. 11 is a perspective view of a fifth embodiment of the multi-turning connecting head of the present invention.

Reference is made to FIG. 11. The second connector 2 can be a cable connector and the first connector 1 can be also a cable connector (not shown).

Figure 12:
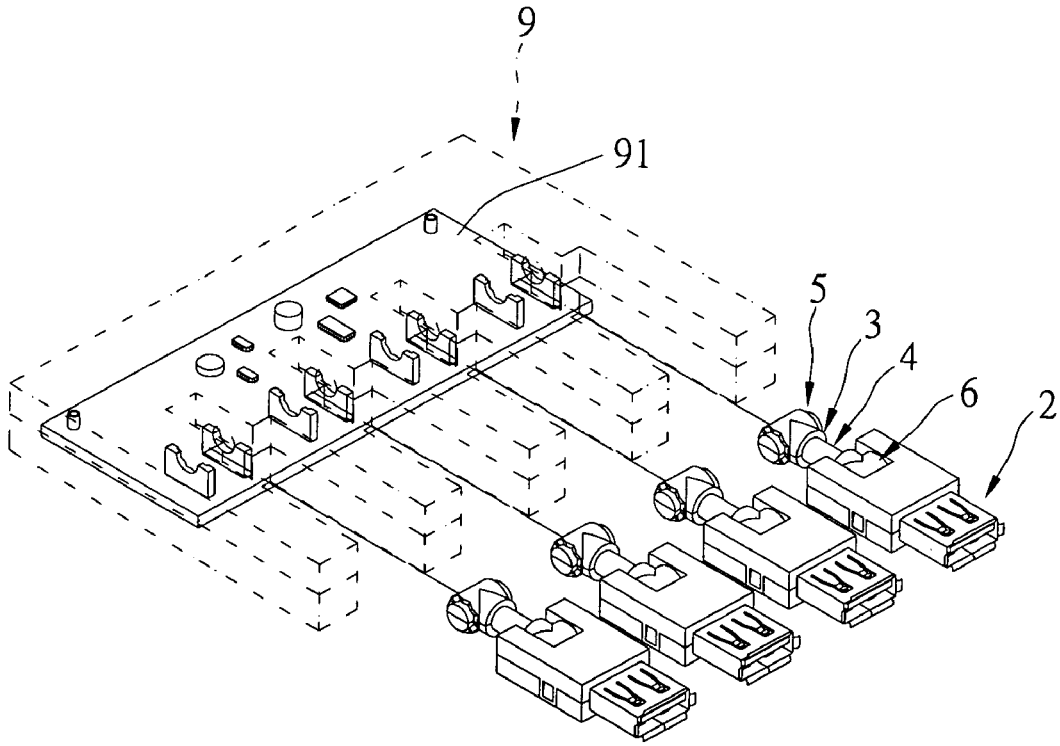
FIG. 12 is a perspective view of a sixth embodiment of the multi-turning connecting head of the present invention.

Reference is made to FIG. 12. The first connector 1 can be neglected, that is the first shaft 5 is directly rotatably pivotally engaged on a circuit board 91 of a hub 9 so that the multi-turning connecting head is applied to the hub 9. The circuit board 91 is connected with the second connector 2 by a signal cable (not shown).

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A connector assembly comprising:

a signal cable;

a first connector;

a second connector connected with the first connector by the signal cable;

at least one outer sliding element;

at least one inner sliding element slidable and rotable with respect to the outer sliding element;

a first shaft rotatably and pivotally engaged with the first connector; and a second shaft rotatably and pivotally engaged with the second connector, wherein the outer sliding element and the inner sliding element connected between the first shaft and the second shaft.

2. The connector assembly as in claim 1, wherein the first connector comprises an insulated housing, a plurality of terminals disposed on the insulated housing, a shielding casing covering the insulated housing and the terminals, and a rear end of the shielding casing is covered with an outer casing.

3. The connector assembly as in claim 2, wherein a rear end of the outer casing of the first connector forms a notch, the outer sliding element and the first shaft are contained in the notch.

4. The connector assembly as in claim 2, wherein the outer casing of the first connector has a contacting surface, each of two ends of the first shaft is separately formed with a pivotal portion and the first shaft is pivotally engaged with the contacting surface corresponding to the first connector by the pivotal portions.

5. The connector assembly as in claim 1, wherein the second connector comprises an insulated housing, a plurality of terminals disposed on the insulated housing, a shielding casing covering the insulated housing and the terminals, and a rear end of the shielding casing is covered with an outer casing.

6. The connector assembly as in claim 5, wherein a rear end of the outer casing of the second connector forms a notch, the inner sliding element and the second shaft are contained in the notch.

7. The connector assembly as in claim 5, wherein the outer casing of the second connector has a contacting surface, each of two ends of the second shaft is separately formed with a pivotal portion and the second shaft is pivotally engaged with the contacting surface corresponding to the second connector by the pivotal portions.

8. The connector assembly as in claim 1, wherein the outer sliding element is an outer sleeve.

9. The connector assembly as in claim 1, wherein the outer sliding elements are sliding surfaces separately formed inside of the first shaft and of the second shaft, the sliding surfaces are cambered surfaces slidingly hitched outside of the inner sliding element.

10. The connector assembly as in claim 1, wherein the inner sliding element is an inner sleeve.

11. The connector assembly as in claim 1, wherein each of two ends of the inner sliding element separately forms a flange pressed to an outer edge of the outer sliding element.

12. The connector assembly as in claim 1, wherein the first shaft is integrally formed with the outer sliding element.

13. The connector assembly as in claim 1, wherein the first shaft is engaged with the first connector by ratchets.

14. The connector assembly as in claim 1, wherein the second shaft is integrally formed with the inner sliding element.

15. The connector assembly as in claim 1, wherein the second shaft is engaged with the second connector by ratchets.

16. The connector assembly as in claim 1, wherein the first connector and the second connector separately has a positioning element and the first shaft and the second shaft are separately pivotally engaged with the positioning element, each of the two positioning elements forms a positioning portion, and the first shaft and the second shaft separately has the ratchets and the positioning portions of the two positioning elements press on the ratchets.

17. The connector assembly as in claim 1, wherein the signal cable is penetrated inside of the outer sliding element and inside of the inner sliding element, and two ends of the signal cable are passed in the middle of the first shaft and the second shaft or through two ends of the first shaft and the second shaft.

18. The connector assembly as in claim 1, wherein the first connector or the second connector has a fingerprint verifier.

* * * * *